US007083009B2

(12) United States Patent
Paluch et al.

(10) Patent No.: US 7,083,009 B2
(45) Date of Patent: Aug. 1, 2006

(54) PRESSURE CONTROLLED FLUID SAMPLING APPARATUS AND METHOD

(75) Inventors: William C. Paluch, Jersey Village, TX (US); Michael J. Moody, Katy, TX (US)

(73) Assignee: PathFinder Energy Services, Inc., Houston, TX (US)

( * ) Notice: Subject to any disclaimer, the term of this patent is extended or adjusted under 35 U.S.C. 154(b) by 252 days.

(21) Appl. No.: 10/633,853

(22) Filed: Aug. 4, 2003

(65) Prior Publication Data

US 2005/0028973 A1 Feb. 10, 2005

(51) Int. Cl.
*E21B 49/08* (2006.01)
*E21B 36/04* (2006.01)

(52) U.S. Cl. ..... 175/59; 166/60; 166/250.17; 166/264; 73/152.28

(58) Field of Classification Search ..... 166/250.01, 166/250.17, 264, 302, 57, 60, 61, 100, 162, 166/167; 175/40, 48, 58, 59; 73/152.01, 73/152.03, 152.19, 152.17, 152.23, 152.28, 73/152.43
See application file for complete search history.

(56) References Cited

U.S. PATENT DOCUMENTS

| | | | | |
|---|---|---|---|---|
| 1,619,328 | A | 3/1927 | Benckenstein | |
| 2,978,046 | A | 4/1961 | True | |
| 4,406,335 | A | 9/1983 | Koot | |
| 4,615,399 | A | 10/1986 | Schoeffler | |
| 4,676,096 | A | 6/1987 | Bardsley | |
| 4,745,802 | A | 5/1988 | Purfurst | |
| 4,766,955 | A * | 8/1988 | Petermann | 166/167 |
| 4,898,236 | A | 2/1990 | Sask | |
| 5,101,907 | A | 4/1992 | Schultz et al. | |
| 5,230,244 | A | 7/1993 | Gilbert | |
| 5,303,775 | A | 4/1994 | Michaels et al. | |
| 5,329,811 | A | 7/1994 | Schultz et al. | |
| 5,337,822 | A | 8/1994 | Massie et al. | |
| 5,377,755 | A | 1/1995 | Michaels et al. | |
| 5,518,073 | A | 5/1996 | Manke et al. | |
| 5,540,280 | A | 7/1996 | Schultz et al. | |
| 5,549,162 | A | 8/1996 | Moody et al. | |
| 5,555,945 | A | 9/1996 | Schultz et al. | |
| 5,558,162 | A | 9/1996 | Manke et al. | |
| 5,597,016 | A | 1/1997 | Manke et al. | |

(Continued)

FOREIGN PATENT DOCUMENTS

EP 0295922 A3 12/1988

(Continued)

OTHER PUBLICATIONS

The Expro Group, "Reservoir Fluid Sampling", 102-CH/008, Rev 04-09/01, downloaded from www.exprogroup.com, on Oct. 4, 2002.

(Continued)

*Primary Examiner*—Jennifer H. Gay

(57) ABSTRACT

A formation fluid sampling tool including at least one sample tank mounted in a tool collar. The tool collar includes a through bore and is disposed to be operatively coupled with a drill string such that each sample tank may receive a correspondingly preselected formation fluid sample without removing the drill string from a well bore. At least one of the sample tanks further includes an internal fluid separator movably disposed therein. The separator separates a sample chamber from a pressure balancing chamber in the sample tank. The pressure balancing chamber is disposed to be in fluid communication with drilling fluid exterior thereto. The sampling tool further includes a sample inlet port connected to the sample chamber by an inlet passageway.

39 Claims, 4 Drawing Sheets

U.S. PATENT DOCUMENTS

| | | | | |
|---|---|---|---|---|
| 5,649,597 | A | 7/1997 | Ringgenberg | |
| 5,687,791 | A | 11/1997 | Beck et al. | |
| 5,743,334 | A | 4/1998 | Nelson | |
| 5,791,414 | A | 8/1998 | Skinner et al. | |
| 5,799,733 | A | 9/1998 | Ringgenberg et al. | |
| 5,803,186 | A | 9/1998 | Berger et al. | |
| 5,807,082 | A | 9/1998 | Skinner et al. | |
| 5,813,460 | A | 9/1998 | Ringgenberg et al. | |
| 5,826,662 | A | 10/1998 | Beck et al. | |
| 5,901,788 | A | 5/1999 | Brown et al. | |
| 5,901,796 | A | 5/1999 | McDonald | |
| 5,911,285 | A | 6/1999 | Stewart et al. | |
| 5,979,572 | A | 11/1999 | Boyd et al. | |
| 6,006,834 | A | 12/1999 | Skinner | |
| 6,065,355 | A | 5/2000 | Schultz | |
| 6,148,914 | A * | 11/2000 | Guieze | 166/264 |
| 6,189,612 | B1 | 2/2001 | Ward | |
| 6,216,782 | B1 * | 4/2001 | Skinner | 166/250.01 |
| 6,236,620 | B1 | 5/2001 | Schultz et al. | |
| 6,439,307 | B1 * | 8/2002 | Reinhardt | 166/264 |
| 6,557,632 | B1 * | 5/2003 | Cernosek | 166/264 |
| 6,609,568 | B1 * | 8/2003 | Krueger et al. | 166/250.07 |
| 6,622,554 | B1 * | 9/2003 | Manke et al. | 73/152.55 |
| 6,688,390 | B1 * | 2/2004 | Bolze et al. | 166/264 |
| 6,702,017 | B1 * | 3/2004 | Corrigan et al. | 166/264 |
| 2002/0060067 | A1 * | 5/2002 | Bolze et al. | 166/264 |
| 2002/0112854 | A1 * | 8/2002 | Krueger et al. | 166/250.07 |
| 2002/0129936 | A1 * | 9/2002 | Cernosek | 166/264 |
| 2003/0085039 | A1 * | 5/2003 | DiFoggio | 166/302 |
| 2004/0231842 | A1 * | 11/2004 | Shammai et al. | 166/264 |
| 2005/0028974 | A1 * | 2/2005 | Moody | 166/264 |

FOREIGN PATENT DOCUMENTS

| | | | |
|---|---|---|---|
| WO | WO-0034624 | A2 | 6/2000 |
| WO | WO-0133044 | A1 | 5/2001 |
| WO | WO-0133045 | A1 | 5/2001 |
| WO | WO-0229196 | A2 | 4/2002 |

OTHER PUBLICATIONS

The Expro Group, "Exothermal temperature compensated reservoir fluid sampling tool", 102-CH/063, REV 02-12/00, downloaded from www.exprogroup.com, on Oct. 4, 2002.

* cited by examiner

PRESSURE CONTROLLED FLUID SAMPLING APPARATUS AND METHOD

FIELD OF THE INVENTION

The present invention relates generally to the drilling of oil and/or gas wells, and more specifically, to a formation fluid sampling tool and method of use for acquiring and preserving substantially pristine formation fluid samples.

BACKGROUND INFORMATION

The commercial development of hydrocarbon (e.g., oil and natural gas) fields requires significant capital investment. Thus it is generally desirable to have as much information as possible pertaining to the contents of a hydrocarbon reservoir and/or geological formation in order to determine its commercial viability. There have been significant advances in measurement while drilling and logging while drilling technology in recent years (hereafter referred to as MWD and LWD, respectively). These advances have improved the quality of data received from downhole sensors regarding subsurface formations. It is nonetheless still desirable to obtain one or more formation fluid samples during the drilling and completion of an oil and/or gas well. Once retrieved at the surface, these samples typically undergo specialized chemical and physical analysis to determine the type and quality of the hydrocarbons contained therein. In general, it is desirable to collect the samples as early as possible in the life of the well to minimize contamination of the native hydrocarbons by drilling damage.

As is well known to those of ordinary skill in the art, formation fluids (e.g., water, oil, and gas) are found in geological formations at relatively high temperatures and pressures (as compared to ambient conditions at the surface). At these relatively high temperatures and pressures, the formation fluid is typically a single-phase fluid, with the gaseous components being dissolved in the liquid. A reduction in pressure (such as may occur by exposing the formation fluid to ambient conditions at the surface) typically results in the separation of the gaseous and liquid components. Cooling of the formation fluid towards such ambient temperatures typically results in a reduction in volume (and therefore a reduction in pressure if the fluid is housed in a sealed container), which also tends to result in a separation of the gaseous and liquid components. Cooling of the formation fluid may also result in substantially irreversible precipitation and/or separation of other compounds previously dissolved therein. Thus it is generally desirable for a sampling apparatus to be capable of substantially preserving the temperature and/or pressure of the formation fluid in its pristine formation condition.

Berger et al., in U.S. Pat. No. 5,803,186, disclose an apparatus and method for obtaining samples of formation fluid using a work string designed for performing other downhole work such as drilling, workover operations, or re-entry operations. The apparatus includes sensors for sensing downhole conditions while using a work string that permits working fluid properties to be adjusted without withdrawing the work string from the well bore. The apparatus also includes a relatively small integral sample chamber coupled to multiple input and output valves for collecting and housing a formation fluid sample.

Schultz et al., in U.S. Pat. No. 6,236,620, disclose an apparatus and method for drilling, logging, and testing a subsurface formation without removing the drill string from the well bore. The apparatus includes a surge chamber and surge chamber receptacle for use in sampling formation fluids. The surge chamber is lowered through the drill string into engagement with the surge chamber receptacle, receives a sample of formation fluid, and then is retrieved to the surface. Repeated sampling may be accomplished without removing the drill string by removing the surge chamber, evacuating it, and then lowering it back into the well. While the Berger and Schultz apparatuses apparently permit samples to be collected relatively early in the life of a well, without retrieval of the drill string, they include no capability of preserving the temperature and/or pressure of the formation fluid. Further, it is a relatively complex operation to remove the formation fluid sample from the Berger apparatus.

Michaels et al., in U.S. Pat. Nos. 5,303,775 and 5,377,755, disclose a Method and Apparatus for Acquiring and Processing Subsurface Samples of Connate Fluid in which one or more fluid sample tanks are pressure balanced with respect to the well bore at formation level (hydrostatic pressure). The sample tank(s) are filled with a connate fluid sample in such a manner that during filling thereof the pressure of the connate fluid is apparently maintained within a predetermined range above the bubble point of the fluid. Massie et al., in U.S. Pat. No. 5,337,822, disclose a Well Fluid Sampling Tool for retrieving single-phase hydrocarbon samples from deep wells in which a sample is pressurized by a hydraulically driven floating piston powered by high-pressure gas acting on another floating piston. One drawback of the Michaels and Massie apparatuses is that they require prior withdrawal of the drill string before they can be lowered into the well bore, which typically involves significant cost and time, and increases the risk of subsurface damage to the formation of interest.

Therefore, there exists a need for improved apparatuses and methods for obtaining samples of formation fluid from a well. In particular, there exists a need for an apparatus that does not require retrieval of the drill string from the well and that has the capability of preserving the sample of formation fluid in substantially pristine condition.

SUMMARY OF THE INVENTION

In one aspect this invention includes a formation fluid sampling tool. The tool includes at least one sample tank mounted in a tool collar, the tool collar including a through bore and disposed to be operatively coupled with a drill string such that each sample tank may receive a correspondingly preselected formation fluid sample without removing the drill string from a well bore. At least one of the sample tanks further includes an internal fluid separator movably disposed therein. The separator separates a sample chamber from a pressure balancing chamber in the sample tank. The pressure balancing chamber is disposed to be in fluid communication with drilling fluid exterior thereto. The sampling tool further includes a sample inlet port connected to the sample chamber by an inlet passageway. Certain other embodiments may further include a heating module in thermal communication with the sample chamber for controlling the temperature of a fluid sample.

In another aspect, this invention includes a logging while drilling tool including the sampling tool substantially according to the preceding paragraph and further including at least one packer assembly for sealing the wall of the well bore around the tool and a fluid identification module including at least one sensor disposed to sense a physical property of a formation fluid.

In still another aspect this invention includes a method for acquiring a formation fluid sample from a formation of interest. The method includes providing a formation fluid sampling tool as described substantially according to the preceding paragraphs, coupling the sampling tool with a drill string, positioning the sampling tool adjacent a formation of interest, and pumping formation fluid into the sample chamber.

The foregoing has outlined rather broadly the features and technical advantages of the present invention in order that the detailed description of the invention that follows may be better understood. Additional features and advantages of the invention will be described hereinafter, which form the subject of the claims of the invention. It should be appreciated by those skilled in the art that the conception and the specific embodiment disclosed may be readily utilized as a basis for modifying or designing other structures for carrying out the same purposes of the present invention. It should be also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
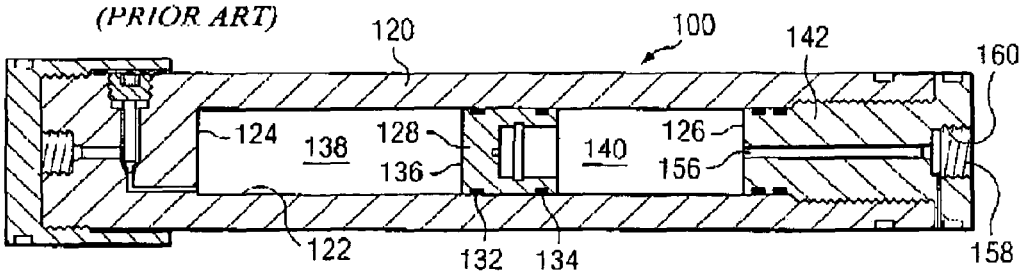
FIG. 1 (PRIOR ART)
FIG. 1 is a cross sectional view of a pressurized sample tank assembly of the prior art.

The present invention addresses difficulties in acquiring and preserving samples of pristine formation fluid, including those difficulties described above. This invention includes a sampling tool for obtaining samples of relatively pristine formation fluid without removing the drill string from the well bore. Sampling tools according to this invention may retrieve samples from any depth, including both deep and shallow wells. Embodiments of the sampling tool of this invention are configured for coupling to a drill string and include a through bore, allowing drilling fluid (such as drilling mud) to flow therethrough. Embodiments of the tool include one or more sample tanks, each of which advantageously includes a movable internal fluid separator disposed therein which divides the tank into a sample chamber and a pressure balancing chamber. In one embodiment, the pressure balancing chamber may be in fluid communication with the through bore and thus pressure balanced with the drilling fluid. In other embodiments, the pressure of the drilling fluid may be controlled by arrangements that restrict the flow of mud through the tool. Embodiments of the sampling tool of this invention also optionally include on-board electronics disposed to control the collection of multiple samples of pristine formation fluid at predetermined instants or intervals of time.

Exemplary embodiments of the present invention advantageously provide for improved sampling of formation fluid from, for example, deep wells. In particular, embodiments of this invention are configured to try to maintain, for as long as possible, the fluid at or greater than about the pressure of the formation. Further, samples from one formation may be obtained at different pressures, which may give valuable insight into the effect of various completion procedures. Embodiments of this invention may also be advantageous in that the sample pressure is controllable by controlling surface hydraulics (e.g., drilling fluid pump pressure). Other embodiments of this invention may further advantageously control the sample temperature so as, for example, to maintain the fluid at about the same temperature as found in the formation.

Embodiments of the sampling tool of this invention, in combination with a logging while drilling (LWD) tool or a measurement while drilling (MWD) tool, for example, are couplable to a drill string, and thus in such a configuration provide for sampling of formation fluid shortly after penetration of the formation of interest. Advantages are thus provided for the acquisition and preservation of relatively high quality formation fluid samples in substantially pristine condition. These high quality samples may provide for more accurate determination of formation properties and thus may enable a better assessment of the economic viability of an oil and/or gas reservoir. These and other advantages of this invention will become evident in light of the following discussion of various embodiments thereof.

Referring now to FIG. 1, a portion of one example of a prior art formation fluid sampling tool is illustrated (FIG. 1 is abstracted from U.S. Pat. Nos. 5,303,775 and 5,377,755, hereafter referred to as the Michaels patents). The Michaels patents disclose a cable or wireline apparatus for acquisition of a sample of connate fluid from a well bore. Samples are obtained by pumping the connate fluid with a bidirectional piston pump (not shown) into a sample tank 100 that is pressure balanced with respect to the fluid pressure of the borehole at formation level (i.e., hydrostatic pressure). As shown in FIG. 1, the Michaels patents teach a sample tank 100 including a tank body structure 120, which forms an inner cylinder defined by an internal cylindrical wall surface 122 and opposed end walls 124 and 126. A free floating piston member 128 is movably positioned within the cylinder and incorporates one or more seal assemblies 132 and 134 which provide the piston with high pressure containing capability. The piston 128 is a free floating piston which is typically initially positioned such that its end wall 136 is positioned in abutment with the end wall 124 of the cylinder. The piston 128 functions to partition the cylinder into a sample containing chamber 138 and a pressure balancing chamber 140. When the sample tank is full, the piston 128 is seated against a support shoulder 126 of a closure plug 142.

The closure plug 142 (also referred to as a sample tank plug in the Michaels patents) includes a pressure balancing passage 156, which may be closed by a small closure plug 158 receivable in an internally threaded receptacle 160. While positioned downhole, the closure plug 158 is removed, thereby permitting entry of formation pressure into the pressure balancing chamber 140. As the connate fluid sample is pumped into the sample chamber 138, a slight pressure differential develops across the piston 128 and, because it is free-floating, the piston 128 moves towards the support shoulder 126. When the piston 128 has moved into contact with the support shoulder 126, the sample chamber 138 is assumed to be completely filled.

Figure 2:
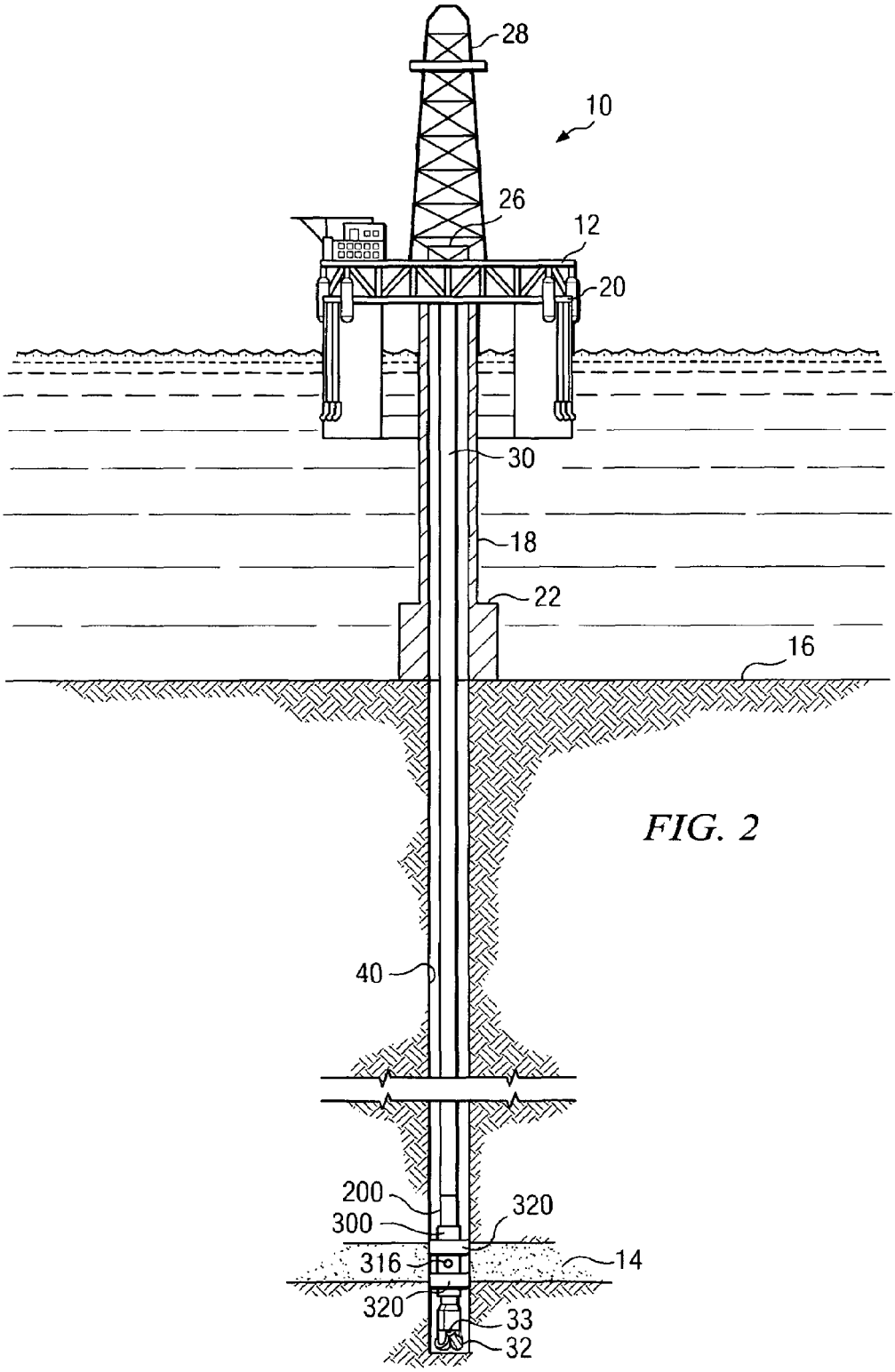
FIG. 2 is a schematic representation of an offshore oil and/or gas drilling platform utilizing an exemplary embodiment of the present invention.

Referring now to FIGS. 2 through 5, exemplary embodiments of the present invention are illustrated. FIG. 2 schematically illustrates one exemplary embodiment of a sampling module 200 according to this invention in use in an offshore oil or gas drilling assembly, generally denoted 10. In FIG. 2, a semisubmersible drilling platform 12 is positioned over an oil or gas formation 14 disposed below the sea floor 16. A subsea conduit 18 extends from deck 20 of platform 12 to a wellhead installation 22. The platform may include a derrick 26 and a hoisting apparatus 28 for raising and lowering the drill string 30 including drill bit 32, sampling module 200, and formation tester 300. Drill string 30 may further include a downhole drill motor, a mud pulse telemetry system, and one or more sensors, such as a nuclear logging instrument, for sensing downhole characteristics.

During a drilling, testing, and sampling operation, drill bit 32 is rotated on drill string 30 to create a well bore 40. Shortly after the drill bit 32 intersects the formation 14 of interest, drilling typically stops to allow formation testing before contamination of the formation occurs, e.g., by invasion of working fluid or filter cake build-up. Expandable packers 320 are inflated to sealing engage the wall of well bore 40. The inflated packers 320 isolate a portion of the well bore 40 adjacent the formation 14 to be tested. Formation fluid is then received at port 316 of formation tester 300 and may be pumped into one or more sample chambers 224 (illustrated on FIG. 3A). As described in more detail hereinbelow with respect to FIG. 5, embodiments of formation tester 300 may include a fluid identification module 310 including one or more sensors for sensing properties of the various fluids that may be encountered. Formation tester 300 may further pass fluid through a fluid passageway to one or more sample tanks housed in sample module 200.

It will be understood by those of ordinary skill in the art that the sampling module 200 and the formation tester 300 of the present invention are not limited to use with semisubmersible platform 12 as illustrated in FIG. 1. Sampling module 200 and formation tester 300 are equally well suited for use with any kind of subterranean drilling operation, either offshore or onshore.

Figure 3A:
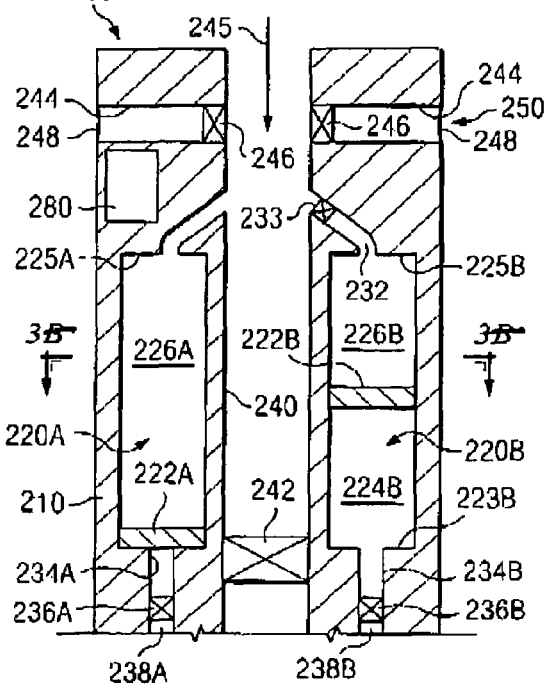
FIG. 3A is a schematic cross-sectional representation of an exemplary embodiment of a sampling apparatus according to this invention.
Figure 3C:
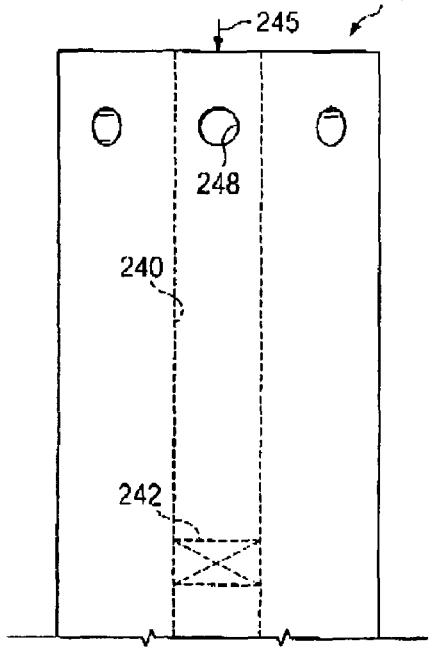
FIG. 3C is a schematic representation, side view, of the exemplary embodiment of FIG. 3A.
Figure 3B:
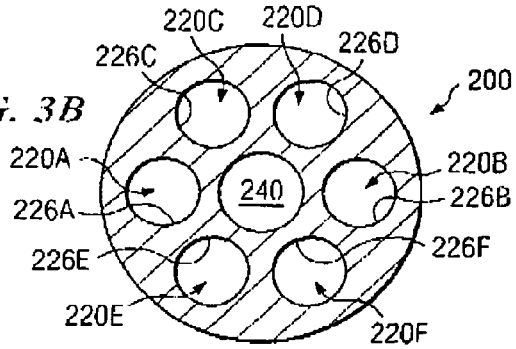
FIG. 3B is a schematic cross-sectional representation along section 3—3 of FIG. 3A.

Referring now to FIGS. 3A through 3C, exemplary embodiments of sampling tool 200 are schematically illustrated in greater detail. It will be understood that like-numbered items denote elements serving corresponding function and structure in the various tank assemblies 220A, 220B, 220C, 220D, 220E, and 220F. Thus a general reference herein to the pressure balancing chamber 226, for example, applies to each of the pressure balancing chambers 226A, 226B, 226C, 226D, 226E, and 226F unless otherwise stated. Sampling tool 200 includes one or more sample tank assemblies 220 (denoted as 220A and 220B on FIG. 3A) disposed in a substantially cylindrical tool body 210 (also referred to herein as a tool collar). Tool body 210 is typically configured for mounting on a drill string, e.g., drill string 30, as illustrated on FIG. 2, and thus may include conventional connectors, such as threads (not shown), at the ends thereof. The sample tank assemblies 220 are disposed about a through bore 240, which passes substantially along the cylindrical axis of the tool body 210.

With reference now to FIG. 3A, exemplary sample tank assemblies 220 of the present invention include an internal fluid separator 222 (e.g., a piston), which is substantially free-floating, movably disposed therein. The separator 222 typically includes seal assemblies (not shown in FIG. 3A), analogous to the high-pressure seal assemblies 132 and 134 shown in FIG. 1. Separator 222 functions to partition the cylinder into a sample chamber 224 and a pressure balancing chamber 226. When the sample chamber 224 is empty, the separator 222 is positioned in abutment with end wall 223 (as shown with respect to separator 222A in tank assembly 220A illustrated on FIG. 3A). Conversely, it will be understood from FIG. 3A that when the sample chamber is full, the separator 222 will be positioned in abutment with end wall 225. The sample chamber 224 is connected to a sample inlet port 238 via a sample inlet passageway 234, which typically further includes a sample inlet valve 236. Pressure balancing chamber 226 may be in fluid communication with the through bore 240 via a pressure balancing passageway 232, which communicates drilling fluid pressure to the pressure balancing chamber 226. Passageway 232 may optionally include a valve 233 for opening and closing the passageway. While the pressure balancing chamber 226 is shown in fluid communication with the through bore 240 in the exemplary embodiment shown in FIG. 3A, the artisan of ordinary skill will readily recognize that the pressure balancing chamber 226 may alternatively be in fluid communication with the well bore through the exterior of the tool. Disposing the pressure balancing chamber 226 in fluid communication with the through bore 240, as shown in FIG. 3A, may be advantageous, however, for some applications since the drilling fluid pressure in the through bore 240 is typically higher than that in the well bore.

Referring now to FIG. 3B, a cross-sectional representation of sampling module 200 is shown along section 3—3 of FIG. 3A. As shown, sampling module 200 includes six substantially cylindrical sampling tank assemblies 220A, 220B, 220C, 220D, 220E, and 220F disposed substantially symmetrically about through bore 240. Pressure balancing chambers 226A through 226F are in view. The artisan of ordinary skill, however, will readily recognize that sampling tool 200 may include substantially any number of sample tank assemblies 220 disposed in substantially any arrangement about the through bore 240. It will likewise be understood that the sample tank assemblies 220 need not be cylindrical, or even shaped similarly one to another, but may have other shapes or cross sections as desired, provided that separator 222 is sized and shaped to be substantially free floating and to provide a seal between pressure balancing chamber 226 and sample chamber 224. For example, the sampling module may include a single annular sample tank assembly. Alternatively, the sample tank assemblies may be substantially rectangular.

Referring again to FIG. 3A, through bore 240 may optionally be in fluid communication with the well bore through the exterior of the tool by a drilling fluid pressure control assembly 250. Drilling fluid pressure control assembly 250 is configured to provide for at least a partial diversion of the flow 245 of drilling fluid from the through bore 240 to the well bore and may include substantially any arrangement for selectively opening and closing a fluid passageway disposed between the through bore 240 and the well bore. For example, assembly 250 may include one or more drill bit jets 33 (FIG. 2), such as are well known in conventional drill bit assemblies, which allow the fluid flow therethrough to be controlled. Alternatively and/or additionally, as shown in FIG. 3A, assembly 250 may include one or more fluid discharge ports 248 connected to the through bore 240 by one or more outlet passageways 244, each of which includes a valve 246, or a suitable equivalent, disposed therein for controlling the flow of drilling fluid from the through bore 240 to the well bore.

As further illustrated on FIG. 3A, sampling tool 200 may optionally further include a valve 242 disposed in the through bore 240 for controlling the flow of the drilling fluid through the tool. During drilling, valve 242 is typically open to allow drilling fluid to flow through the tool 200 to the drill bit. Valves 246 (or other equivalents) are typically closed to prevent diversion of drilling fluid from the through bore 240 to the well bore, thus providing maximum drilling fluid pressure to the drill bit. During sampling, the valve 242 is typically closed, substantially maximizing the drilling fluid pressure in the through bore adjacent passageway 232, thus substantially maximizing the pressure in pressure balancing chamber 226. It will be appreciated that valve 242 is an optional feature of embodiments the sampling tool according to this invention. Artisans of ordinary skill will readily recognize that the function of valve 242 may be similarly achieved, at least in part, for example, by opening and closing drill bit jets on a drill bit assembly.

Drilling fluid pressure control assembly 250 may be advantageous on exemplary embodiments of this invention in that it provides a mechanism for controlling the drilling fluid pressure in the through bore 240, and thus the pressure in pressure balancing chamber 226, which provides for a controllable sample pressure. When the pressure control assembly 250 is closed (e.g., when valves 246 are closed) the pressure of the drilling fluid in the through bore 240 is substantially maximized and tends towards the sum of the hydrostatic pressure and the drilling fluid pump pressure. Controlled release of drilling fluid through the pressure control assembly 250 (e.g., by partially or fully opening one or more of valves 246) controllably reduces the drilling fluid pressure in through bore 240 and thus in pressure balancing chamber 226. It will be appreciated that drilling fluid pressure control assembly 250 is also an optional feature of embodiments of the sampling tool according to this invention. Artisans of ordinary skill will readily recognize that the function of the pressure control assembly 250 may be similarly achieved, at least in part, for example, by controlling the drilling fluid outlet on conventional drill bit jets used on a drill bit assembly.

Valves 236, 242, and 246 as well as other components of the sampling tool are advantageously controllable by an electronic controller 280, shown schematically disposed in tool body 210 on FIG. 3A, for example. A suitable controller might include a programmable processor (not shown), such as a microprocessor or a microcontroller, and may also include processor-readable or computer-readable program code embodying logic, including instructions for controlling the function of the valves 236, 242, and 246. A suitable controller 280 may also optionally include other controllable components, such as sensors, data storage devices, power supplies, timers, and the like. The controller 280 may be disposed in electronic communication with one or more pressure and/or temperature probes (not shown) appropriately sized, shaped, positioned, and configured for providing relatively accurate pressure and temperature readings, respectively, of the interior of the sample chambers 224. The controller 280 may also be disposed in electronic communication with other sensors and/or probes for monitoring other physical parameters of the samples. The controller 280 may further be disposed in electronic communication with still other sensors for measuring well bore properties, such as a gamma ray depth detection sensor or an accelerometer, gyro or magnetometer to detect azimuth and inclination. Controller 280 may also optionally communicate with other instruments in the drill string, such as telemetry systems that communicate with the surface. Controller 280 may further optionally include volatile or non-volatile memory or a data storage device. The artisan of ordinary skill will readily recognize that while controller 280 is shown disposed in collar 210, it may alternately be disposed elsewhere, such as in identification module 310 of fluid tester 300 (shown in FIG. 6 and discussed in further detail hereinbelow).

Referring now to FIG. 3C, a side view of one embodiment of the sampling module 200 of this invention is illustrated with the corresponding part numbers to FIG. 3A. In the embodiment shown, the substantially cylindrical tool collar 210 includes a plurality of fluid discharge ports 248 disposed therein. Through bore 240 and valve 242 are shown as hidden details.

Figure 4:
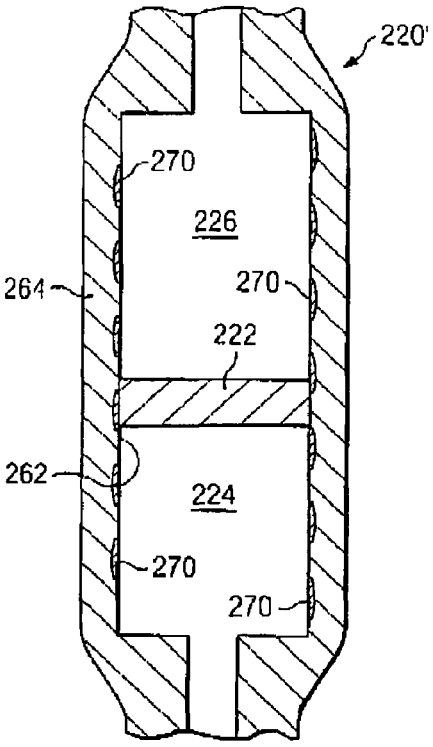
FIG. 4 is a schematic representation of an exemplary embodiment of a sample tank used in the sampling apparatus of FIG. 3A.

Referring now to FIG. 4, a schematic representation of an exemplary embodiment of a sample tank assembly 220' is illustrated. As described above with respect to FIG. 3A, the sample tank assembly 220' includes a separator 222 interposed between a sample chamber 224 and a pressure balancing chamber 226. The chamber wall 262 may be fabricated from, for example, stainless steel or a titanium alloy, although it will be appreciated that it may be fabricated from substantially any suitable material in view of the service temperatures and pressures, exposure to corrosive formation fluids, and other downhole conditions. Optionally, as illustrated on FIG. 4, the chamber wall may further be surrounded by one or more insulating layers 264. For example, insulating layer 264 may include substantially any suitable thermally insulating material, such as a polyurethane coating or an aerogel foam, disposed on chamber wall 262. Insulating layer 264 may further include an evacuated region (not illustrated), the vacuum around the chamber wall 262 further enhancing the thermal insulation. In one desirable embodiment insulating layer 264 is sufficient to substantially maintain the temperature of a sample at the formation temperature, the sample chamber 224 having an r-value, for example, greater than or equal to about 12.

With further reference to the embodiment of FIG. 4, sample tank assembly 220' may further include a heating module 270, such as an electrical resistance heater in the form of a tape, foil, or chain wound around the chamber wall 262. The chamber wall 262 may alternately be coated with an electrically resistive coating. The heating module 270 is typically communicably coupled to controller 280 (shown on the embodiment of FIG. 3A). In embodiments in which the heating module 270 includes an electrical heating mechanism, electric power may be provided by substantially any known electrical system, such as a battery pack mounted in the tool body 210, or elsewhere in the drill string, or a turbine disposed in the flow of drilling fluid. Alternatively and/or additionally, the sample chamber 224 may be heated using other known heating arrangements, e.g., by a controlled exothermic chemical reaction in a separate chamber (not shown).

Figure 5A:
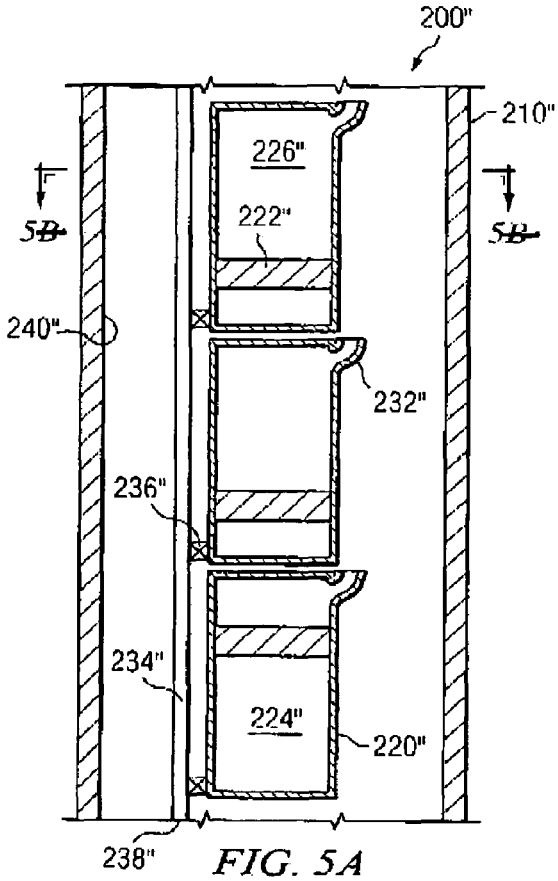
FIG. 5A is a schematic cross-sectional representation of another exemplary embodiment of a sampling apparatus according to this invention.
Figure 5B:
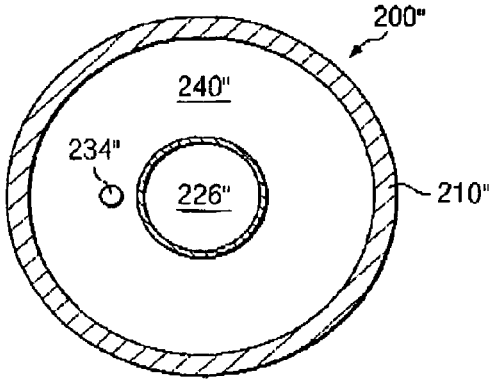
FIG. 5B is a schematic cross-sectional representation along section 5—5 of FIG. 5A.

Referring now to FIGS. 5A and 5B, cross sectional views of another embodiment of an exemplary sampling module 200" of this invention are illustrated. Sampling module 200" is similar to sampling module 200 described above with respect to FIGS. 3A through 3C in that it includes at least one sample tank assembly 220" disposed in a substantially cylindrical tool body 210". Sampling module 200" differs from that of sampling module 200 in that one or more of the sample tank assemblies 220" are disposed in the through bore 240" (substantially in the flow of drilling fluid when the sampling module 200" is coupled to a drill string), for example, substantially coaxially with the tool body 210". Each of the sample tank assemblies 220" is similar to sample tank assembly 220 described above with respect to FIG. 3A in that they include a separator 222" disposed between a sample chamber 224" and a pressure balancing chamber 226". The sample chamber 224" is connected to a sample inlet port 238" via a sample inlet passageway 234", which typically further includes a sample inlet valve 236". The pressure balancing chamber 226" is in fluid communication with drilling fluid in the through bore 240" via a pressure balancing passageway 232".

Figure 6:
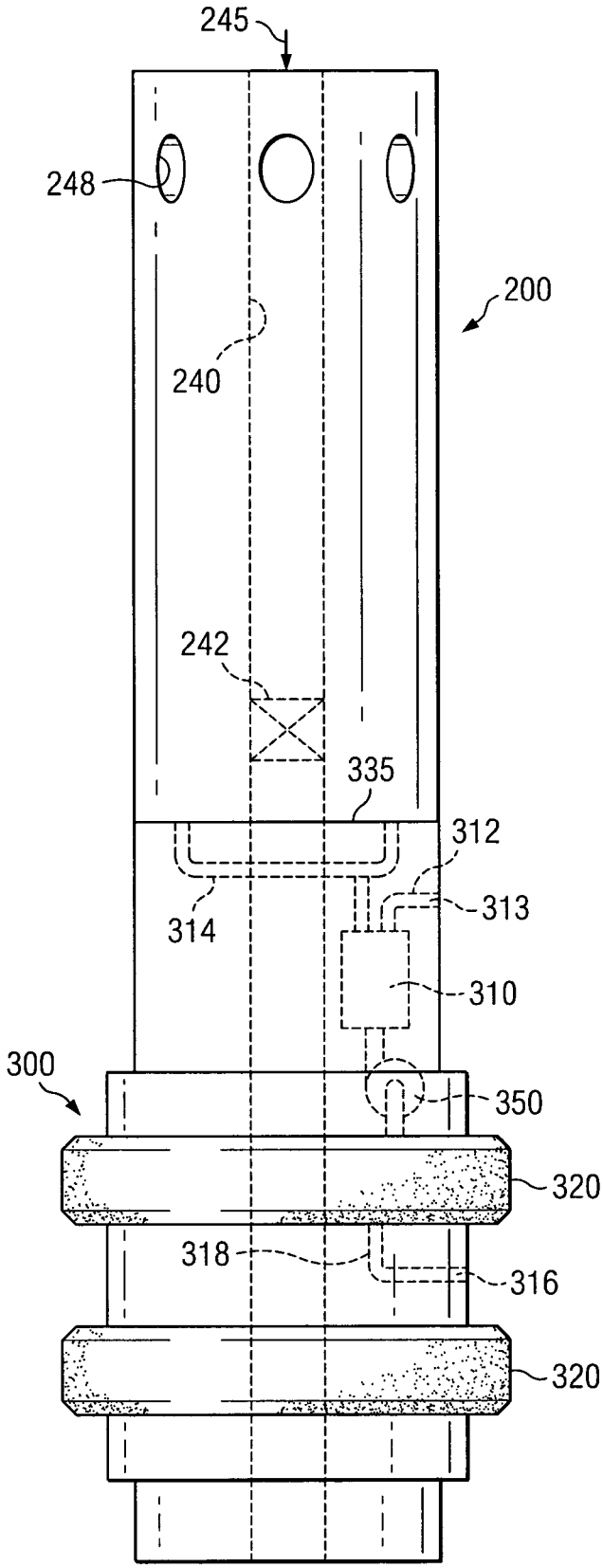
FIG. 6 is a schematic representation of yet another exemplary embodiment of a sampling apparatus according to this invention.

Referring now to FIG. 6, another exemplary embodiment of the present invention includes a sampling module 200 according to FIGS. 3A, 3B and 3C coupled to a formation tester 300 (e.g., a LWD and/or MWD tool). While sampling module 200 and formation tester 300 are shown coupled at 335 (e.g., threaded to one another), the artisan of ordinary skill will readily recognize that consistent with the present invention they may also be fabricated as an integral unit. Formation tester 300 may be according to embodiments described and claimed in U.S. Pat. No. 6,236,620 to Schultz, et al. and typically includes one or more packer elements 320 for selectively sealing the wall of the well bore around formation tester 300. The embodiment shown in FIG. 6 includes two packer elements 320 for isolating a substantially annular portion of the well bore adjacent a formation of interest. The packer elements 320 comprise any type packer element, such as a compression type or an inflatable type. Inflatable type packer elements 320 may be inflated by substantially any suitable technique, such as by injecting a pressurized fluid into the packer. The packer elements 320 may further include optional covers (not illustrated in FIG. 6) to shield the components thereof from the potentially damaging effects of the various forces encountered during drilling (e.g., collisions with the wall of the well bore).

With continued reference to FIG. 6, the formation tester 300 further includes at least one inlet port 316 disposed between packer elements 320. In embodiments including only one packer element 320, inlet port 316 is typically disposed below the packer element 320 (i.e., further towards the bottom of the well). Inlet port 316 is connected to a fluid identification module 310 via fluid passageway 318. Fluid identification module 310 typically includes instrumentation including one or more sensors for monitoring and recording properties of the various fluids that may be encountered in the well bore, from which a fluid type may be determined. For example, sensor measurements may distinguish between working fluid (e.g., drilling mud) and formation fluid. The fluid identification module 310 may include any of a relatively wide variety of sensors, including a resistivity sensor for sensing fluid or formation resistivity and a dielectric sensor for sensing the dielectric properties of the fluid or formation. Module 310 may further include pressure sensors, temperature sensors, optical sensors, acoustic sensors, nuclear magnetic resonance sensors, density sensors, viscosity sensors, pH sensors, and the like. Fluid identification module 310 typically further includes numerous valves and fluid passageways (not shown) for directing formation fluid to the various sensors and for directing fluid to, for example, a sample output passageway 314 or a fluid discharge passageway 312, which is connected to output port 313.

Formation tester 300 typically further includes a control module (not shown) of analogous purpose to that described above with respect to controller 280. The control module, for example, controls the function of the various sensors described above and communicates sensor output with operators at the surface, for example, by conventional mud telemetry or electric line communications techniques. The control module may also be further communicably coupleable with controller 280.

In operation, formation tester 300 is positioned adjacent to a formation of interest in the well bore. The packer elements 320 are inflated, thereby isolating a substantially annular portion of the well bore adjacent the formation. One or more pumps 350 are utilized to pump formation fluid into the tool at port 316. The pump 350 may include, for example, a bidirectional piston pump, such as that disclosed in the Michaels patents, or substantially any other suitable pump in view of the service temperatures and pressures, exposure to corrosive formation fluids, and other downhole conditions. Fluid is typically drawn slowly into the tool (rather than flowing by the force of the reservoir pressure) in order to maintain it above its bubble pressure (i.e., the pressure below which a single phase fluid becomes a two phase fluid). Sampled formation fluid is then pumped through the fluid identification module 310 where it is tested using one or more of the various sensors described above. Fluid is typically pumped into module 310 and then discharged from the tool via passageway 312 and output port 313 until it is sensed to have predetermined properties (e.g., a resistivity within a certain range) identifying it as likely to be a substantially pristine formation fluid. Typically, upon first pumping, the formation fluid is contaminated with drilling mud. After some time, however, substantially pristine formation fluid may be drawn into the tool and routed to sampling module 200 via passageway 314. Samples may be obtained using substantially any protocol (e.g., at various time intervals or matching certain predetermined fluid properties measured by identification module 310).

Referring now to FIGS. 3A, with continued reference to FIG. 6, substantially pristine formation fluid may be received at inlet port 238, which is connected to fluid passageway 314, and routed to one or more of the sample chambers 224 through valves 236. Valves 242 and 246 may be closed to maximize the drilling fluid pressure in through bore 240 and pressure balancing chamber 226. Alternatively, one or more of the valves 242 and 246 may be partially or fully opened, allowing the pressure in the through bore 240 and pressure balancing chamber 226 to be set to a predetermined value. Nevertheless, as the formation fluid is introduced into the sample chambers 224, the pump 350 provides sufficient pressure to overcome the pressure in the pressure balancing chamber 226, thus causing a slight pressure differential across the separator 222, which, because it is substantially free floating, moves it towards end wall 225. The sample chambers 224 are substantially filled when the separators 222 contact end wall 225. In exemplary embodiments in which the separators are fitted with high pressure seals (e.g., seals 132 and 134 in FIG. 1), the formation fluid sample may be over-pressured prior to closing valves 236. Valves 233 may then be closed to prevent further over-pressuring, for example, during continued drilling.

As described briefly above, exemplary embodiments of this invention advantageously allow for the acquisition of multiple formation fluid samples at distinct pressures. For example, a first sample may be acquired at a relatively high pressure by substantially closing valve 242 and pressure control assembly 250 (e.g., such that the passageway 244 between through bore 240 and the well bore is substantially closed. Subsequent samples, for example, may be acquired at relatively lower pressures by partially or fully opening pressure control assembly 250, thereby releasing pressure from the through bore (and pressure balancing chamber 226). Exemplary embodiments of this invention thus advantageously allow formation fluid samples to be collected at a relatively wide range of pressures, ranging from about hydrostatic pressure up to about 5000 psi greater than the hydrostatic pressure of the well bore.

Referring also the exemplary embodiment of FIG. 4, if the sample temperature falls significantly (e.g., by more than a few degrees C.), the temperature change may be detected by the controller 280, (e.g., using a thermistor or thermocouple in thermal contact with the sample). In response to the detected temperature drop, the controller 280 may, for example, connect an electrical power supply (e.g., a battery source) with the heating module 270 to heat the sample chamber 224 and thus protect the sample from further cooling.

Although the present invention and its advantages have been described in detail, it should be understood that various changes, substitutions and alternations can be made herein without departing from the spirit and scope of the invention as defined by the appended claims.

We claim:

1. A formation fluid sampling tool comprising:

at least one sample tank mounted in a tool collar;

the tool collar including a through bore, the tool collar disposed to be operatively coupled with a drill string such that the at least one sample tank may receive a correspondingly preselected formation fluid sample without removing the drill string from a well bore;

the at least one sample tank further including an internal fluid separator movably disposed therein, the separator separating a sample chamber from a pressure balancing chamber in the at least one sample tank, the sample chamber being in fluid communication with formation fluid concurrently with the pressure balancing chamber being in fluid communication with drilling fluid exterior to the pressure balancing chamber; and a sample inlet port connected to the sample chamber by an inlet passageway.

2. The formation fluid sampling tool of claim 1, wherein the pressure balancing chamber is disposed to be in fluid communication with drilling fluid exterior to tool collar.

3. The formation fluid sampling tool of claim 1, wherein the pressure balancing chamber is disposed to be in fluid communication with drilling fluid interior to the through bore.

4. The formation fluid sampling tool of claim 1, wherein said drilling fluid exterior to the pressure balancing chamber has a pressure about the same as a hydrostatic pressure in the well bore.

5. The formation fluid sampling tool of claim 1, wherein said drilling fluid exterior to the pressure balancing chamber has a pressure exceeding a hydrostatic pressure in the well bore.

6. The formation fluid sampling tool of claim 1, wherein the at least one sample tank comprises a plurality of sample tanks.

7. The formation fluid sampling tool of claim 1, wherein the at least one sample tank is disposed in the through bore.

8. The formation fluid sampling tool of claim 7, wherein said at least one sample tank is disposed substantially co-axially with the tool collar.

9. The formation fluid sampling tool of claim 1, wherein the at least one sample tank is disposed in the through bore.

10. The formation fluid sampling tool of claim 1, further comprising a pressure control assembly disposed to control flow of drilling fluid between the through bore and the well bore.

11. The formation fluid sampling tool of claim 10, wherein the pressure control assembly comprises at least one drill bit jet.

12. The formation fluid sampling tool of claim 10, wherein the pressure control assembly comprises at least one discharge port to the well bore, each discharge port connected to the through bore by a corresponding outlet passageway, each outlet passageway further including a valve disposed therein for controlling drilling fluid flow between the through bore and the well bore.

13. The formation fluid sampling tool of claim 1, further comprising a valve disposed in the through bore for controlling drilling fluid flow therethrough.

14. The formation fluid sampling tool of claim 1, wherein the at least one sample tank is insulated.

15. The formation fluid sampling tool of claim 14, wherein said at least one insulated sample tank has an r-value of greater than or equal to about 12.

16. The formation fluid sampling tool of claim 1 further comprising a heating module, the heating module in thermal communication with the at least one sample tank.

17. The formation fluid sampling tool of claim 16, wherein the heating module comprises an electrical resistance heater.

18. The formation fluid sampling tool of claim 1, wherein the internal fluid separator includes a seal deployed between the sample chamber and pressure balancing chamber.

19. The formation fluid sampling tool of claim 1, further comprising an electronic controller.

20. The formation fluid sampling tool of claim 1, being coupled to a measurement while drilling tool.

21. The formation fluid sampling tool of claim 1, further comprising a pump.

22. A logging while drilling tool comprising:

at least one sample tank mounted in a tool collar;

the tool collar including a through bore, the tool collar disposed to be operatively coupled with a drill string such that the at least one sample tank may receive a correspondingly preselected formation fluid sample without removing the drill string from a well bore;

the at least one sample tank further including an internal fluid separator movably disposed therein, the separator separating a sample chamber from a pressure balancing chamber in the at least one sample tank, the sample chamber being in fluid communication with formation fluid concurrently with the pressure balancing chamber being in fluid communication with drilling fluid exterior to the pressure balancing chamber;

a packer element for sealing the wall of the well bore around the logging while drilling tool; the packer being selectively positionable between sealed and unsealed positions;

a sample inlet port connected to the sample chamber by an inlet passageway.

23. The logging while drilling tool of claim 22, comprising first and second packer elements, the sample inlet port being disposed between the first and second packer elements.

24. The logging while drilling tool of claim 22, further comprising a fluid identification module including at least one sensor disposed to sense a physical property of a formation fluid.

25. The logging while drilling tool of claim 24, wherein the at least one sensor in the fluid identification module is selected from the group consisting of a resistivity sensor, a dielectric sensor, a pressure sensor, a temperature sensor, an optical sensor, an acoustic sensor, a nuclear magnetic resonance sensor, a density sensor, a viscosity sensor, and a pH sensor.

26. The logging while drilling tool of claim 24, wherein:

a first fluid passageway connects the fluid identification module to the sample chamber; and a second fluid passageway connects the fluid identification module to an output port through which fluid may be expelled from the tool.

27. The logging while drilling tool of claim 22, wherein the pressure balancing chamber is disposed to be in fluid communication with drilling fluid exterior to tool collar.

28. The logging while drilling tool of claim 22, wherein the pressure balancing chamber is disposed to be in fluid communication with drilling fluid interior to the through bore.

29. The logging while drilling tool of claim 22, wherein the at least one sample tank comprises a plurality of sample tanks.

30. The logging while drilling tool of claim 22, further comprising a pressure control assembly disposed to control flow of drilling fluid between the through bore and the well bore.

31. The logging while drilling tool of claim 22, further comprising a valve disposed in the through bore for controlling a flow of drilling fluid therethrough.

32. The logging while drilling tool of claim 22, wherein the at least one sample tank is insulated.

33. The logging while drilling tool of claim 22, further comprising a heating module, the heating module in thermal communication with the at least one sample tank.

34. The logging while drilling tool of claim 22, further comprising a pump.

35. An integrated apparatus for retrieving a fluid sample from a well, the apparatus comprising:

a drill string having a drill bit disposed on one end thereof;

a formation evaluation tool disposed on the drill string proximate to the drill bit; and a formation fluid sampling apparatus also disposed on the drill string proximate to the drill bit, the formation fluid sampling apparatus including:

at least one sample tank mounted in a tool collar;

the tool collar including a through bore, the tool collar disposed to be operatively coupled with a drill string such that the at least one sample tank may receive a correspondingly preselected formation fluid sample without removing the drill string from a well bore;

the at least one sample tank further including an internal fluid separator movably disposed therein, the separator separating a sample chamber from a pressure balancing chamber in the at least one sample tank, the sample chamber being in fluid communication with formation fluid concurrently with the pressure balancing chamber being in fluid communication with drilling fluid exterior to the pressure balancing chamber; and a sample inlet port connected to the sample chamber by an inlet passageway.

36. A method for acquiring a formation fluid sample from a formation of interest in a well, the method comprising:

providing a formation fluid sampling tool including at least one sample tank mounted in a tool collar; the tool collar including a through bore, the tool collar disposed to be operatively coupled with a drill string such that the at least one sample tank may receive a correspondingly preselected formation fluid sample without removing the drill string from a well bore; the at least one sample tank including an internal fluid separator movably disposed therein, the separator separating a sample chamber from a pressure balancing chamber in the at least one sample tank, the sample chamber being in fluid communication with formation fluid concurrently with the pressure balancing chamber being in fluid communication with drilling fluid exterior to the pressure balancing chamber; the sampling tool further including a sample inlet port connected to the sample chamber by an inlet passageway;

coupling the sampling tool with a drill string;

positioning the sampling tool in a well at a location of a formation of interest;

pumping formation fluid into the sample chamber.

37. The method of claim 36, wherein the method further comprises:

coupling a logging while drilling tool to the drill string, the logging while drilling tool in operative communication with the sampling tool; and logging the well with the logging while drilling tool and thereby determining the location of the formation of interest.

38. The method of claim 36, wherein:

the formation fluid sampling tool further comprises a heating module, the heating module in thermal communication with the at least one sample tank; and the method further comprises utilizing the heating module to heat the formation fluid in the at least one sample tank.

39. The method of claim 36, wherein:

the formation fluid sampling tool further comprises a pressure control assembly disposed to control flow of drilling fluid between the through bore and the well; and the method further comprises utilizing the pressure control assembly to control the pressure of drilling fluid in the pressure balancing chamber.

* * * * *